US005345765A

United States Patent [19]

Kinnersly

[11] Patent Number: 5,345,765

[45] Date of Patent: Sep. 13, 1994

[54] STIRLING ENGINES

[75] Inventor: Richard F. Kinnersly, Romsey, United Kingdom

[73] Assignee: ESD Engines Limited, United Kingdom

[21] Appl. No.: 949,483

[22] PCT Filed: Apr. 17, 1991

[86] PCT No.: PCT/GB91/00599

§ 371 Date: Oct. 16, 1992

§ 102(e) Date: Oct. 16, 1992

[87] PCT Pub. No.: WO91/16533

PCT Pub. Date: Oct. 31, 1991

[30] Foreign Application Priority Data

Apr. 17, 1990 [GB] United Kingdom ..... 9008522.6

[51] Int. Cl.[5] ..... F01B 29/10

[52] U.S. Cl. ..... 60/525; 60/517; 92/165 R

[58] Field of Search ..... 92/165 R, 169.4, 107; 60/525, 517

[56] References Cited

U.S. PATENT DOCUMENTS

| | | | |
|---|---|---|---|
| 1,378,353 | 5/1921 | Hutsell | 92/165 R |
| 3,298,286 | 1/1967 | Tyler | 92/165 R |
| 3,548,721 | 12/1970 | Eisennegger | 92/165 R |
| 3,902,404 | 9/1975 | Breit | 92/165 R |
| 4,375,749 | 3/1983 | Ishizaki | 62/6 |
| 4,382,363 | 5/1983 | Rauch | 60/520 |
| 4,404,802 | 9/1983 | Beale | 60/520 |
| 4,532,766 | 8/1985 | White et al. | 60/517 |
| 4,805,408 | 2/1989 | Beale et al. | 60/520 |

FOREIGN PATENT DOCUMENTS

| | | | |
|---|---|---|---|
| 804979 | 5/1951 | Fed. Rep. of Germany . | |
| 0037540 | 3/1980 | Japan | 60/517 |
| 63-16159 | 1/1988 | Japan . | |
| 1569772 | 6/1980 | United Kingdom . | |
| 1600812 | 10/1981 | United Kingdom . | |
| 2101211 | 1/1982 | United Kingdom . | |
| 82/00319 | 2/1982 | World Int. Prop. O. . | |

OTHER PUBLICATIONS

Stirling Auto Engine, E. F. Lindsay Jan. 1983 see entire document. Popular Science.

*Primary Examiner*—Edward K. Look
*Assistant Examiner*—Mark Sgantzos
*Attorney, Agent, or Firm*—Davis, Bujold & Streck

[57] ABSTRACT

A stirling engine with mechanical output through a main shaft (71) has piston(s) (44) reciprocable in cylinder bore(s) (41). Each piston is guided on a fixed piston guide (52) which extends into but not through the piston. This guidance holds the piston clear of mechanical contact with the cylinder bore (41). A separate seal is provided between the piston and the bore. Internal guidance of the piston permits a guidance arrangement where clearances change very little or not at all with changes in temperature of the engine.

15 Claims, 3 Drawing Sheets

STIRLING ENGINES

The invention relates to Stirling engines. In referring to a Stirling engine we include those engines which operate on a cycle resembling the Stirling cycle but with some overlap and merging of the individual phases of the classical Stirling cycle.

BACKGROUND OF THE INVENTION

The invention is applicable particularly but not exclusively to Stirling engines of the multi-cylinder double-acting type. Typical engines of this type have a hot working chamber at one end, normally the upper end and a cold working chamber at the other end of each cylinder separated by the piston, each of these hot and cold working chambers being connected respectively to a cold or hot working chamber of another cylinder. In this way, four closed working volumes are established in each of which the required working fluid is permanently entrapped. Conventional lubricants can not normally be used within the working volume because the lubricant carbonises and carbonised deposits interfere with heat transfer capability.

Differential thermal expansion between a piston and its cylinder in a Stirling engine can be a particularly severe problem. Pistons are normally supported to slide in a bore by axially spaced annular bearing pads which operate in an oil free environment and normally have a high expansion coefficient. The cylinder in the region of the upper bearing pad is normally liquid cooled and so does not experience wide temperature differences or large degrees of expansion. It may also be convenient to make it from a ferrous metal which has a relatively low expansion coefficient. In contrast, the piston may need to operate over a much wider range of temperatures and may be of light alloy with high expansion coefficient. The relatively high expansion of the piston itself and of a bearing pad carried on the piston can be such as to require excessive clearance between the piston and cylinder at low temperatures. The extent of this clearance can be such as to allow substantial angular movement of the piston. A Stirling engine piston often carries a high crown known as a displacer which runs close to but does not contact the cylinder. Lateral movement of the displacer on tilting of the piston, is magnified by its distance from the bearing pads and there can be a risk of inadvertent contact by the displacer with the cylinder wall at low temperatures. Misalignment caused by large clearances can also lead to high wear rates due to edge loading.

If the engine over-heats and clearances diminish to the extent that friction increases, the piston temperature tends to rise more than the cylinder temperature, tending to result in seizure. To guard against this problem during over-heating, a still larger clearance is required at low temperature. Achieving a satisfactory seal in conjunction with low wear and low friction between the piston and cylinder over a complete range of working temperatures and clearances can also be difficult to achieve and has been a major factor in limiting the commercial success of Stirling engines. The problem is even greater with engines requiring a mechanical drive connection to the piston than with free piston engines because a mechanical drive normally involves a side load on the piston.

The arrangement of guiding a piston in a cylinder by annular pads on the piston engaged with the cylinder wall can thus be disadvantageous in a Stirling engine with a mechanical coupling. An object of the present invention is to provide a piston guide arrangement in which these problems are reduced.

SUMMARY OF THE INVENTION

According to the present invention there is provided a Stirling engine comprising a cylinder closed at one end, a piston reciprocable in the cylinder without guiding contact between the outer surface of the piston and the cylinder and a mechanical coupling for connecting reciprocatory movement of the piston to a drive member, wherein a fixed piston guide with external guide surfaces extends in an axial direction within the cylinder towards its closed end and terminates in a recess in a piston and wherein internal guide surfaces on the piston are in sliding engagement with the external guide surfaces of the piston guide, whereby the piston is guided within the cylinder. This arrangement makes it a practical possibility to match thermal expansion rates of piston, pads and guide to give effective guidance over a range of temperatures.

Typically the drive member is a rotary shaft and the coupling is a mechanical linkage.

The coupling to the piston may comprise a lever arm pivotable intermediate its ends and extending through the cylinder wall, connected at one end thereof to the piston and at the other end thereof to a main shaft. These connections are typically indirect connections through further links.

The piston may be provided with annular bearing pads which guide the piston on the piston guide.

The materials and dimensions of the piston, the bearing pads and the piston guide may be such that clearance between the guide and each pad remains substantially constant or increases very slightly with changes in temperature.

BRIEF DESCRIPTION OF THE DRAWING(S)

Embodiments of the invention will now be described with reference to the accompanying drawings in which.

DESCRIPTION OF THE PREFERRED EMBODIMENT(S)

Figure 1:
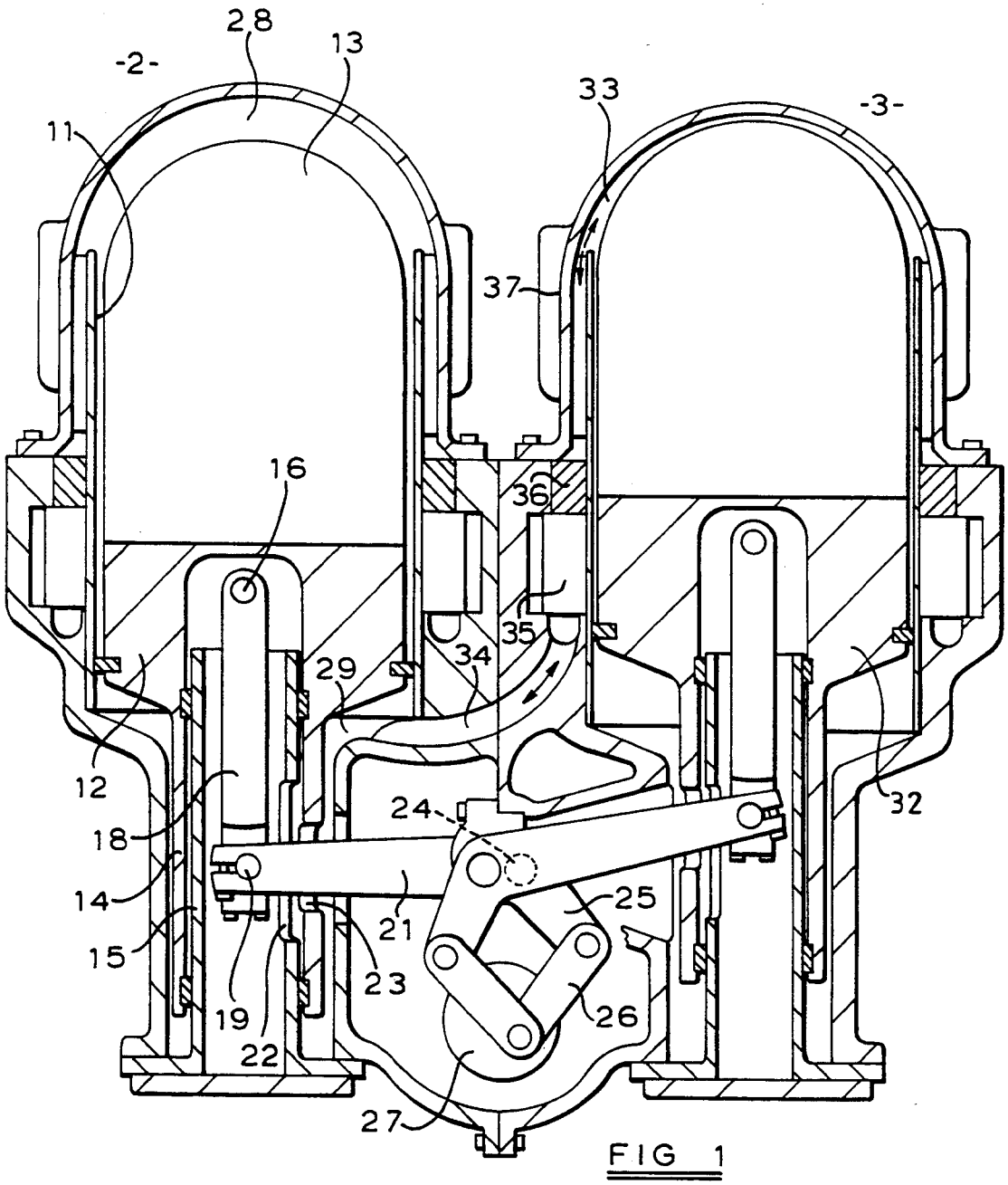
FIG. 1 is a diagrammatic cross-section through a four cylinder engine in accordance with the invention.

FIG. 1 is a diagrammatic cross section through a four cylinder Stirling engine showing two of its cylinders. The engine layout incorporates two banks of two cylinders and one cylinder from each bank is shown. These are referenced cylinders 2 and 3. The other cylinder in the same bank as cylinder 2 is referred to as cylinder 1 and the other cylinder, in the same bank as cylinder 3 is referred to as cylinder 4. Cylinder 2 is typical. It has a main bore 11 in which a piston 12 with integral displacer 13 reciprocates. The piston incorporates a downwardly extending piston body tube 14 which surrounds a fixed tubular piston guide 15 so that the piston 12 is guided on guide 15 rather than by the internal surface of cylinder 11. The cylinder has a major upper diameter corresponding to the full diameter of the piston and a minor lower diameter slightly greater than the diameter of the piston body tube. A generally vertical link 18 connects the piston to a lever arm 21 through pivot pins 16 and 19. The lever arm passes through slots 22 and 23 in the piston guide 15 and piston body tube 14 respectively.

The lever arm has a fixed pivot 24 and a cranked extension 25. A connecting rod 26 interconnects the cranked extension 25 with a crankshaft 27. In this way, reciprocation of piston 12 is connected to rotation of the crankshaft 27.

An upper or hot working chamber 28 is provided within the cylinder above the displacer 13. The space below the piston 12 is closed off and forms a lower or cold working chamber 29. Each cold working chamber is sealed with respect to the crankcase 30 so that the crankcase is unpressurised and parts within it can be lubricated conventionally. The sealing arrangement for arm 21 will be described with reference to FIG. 2.

The mechanical arrangement of a piston 32 for cylinder 3 reciprocable in a cylinder bore 31 is a mirror image of the arrangement for cylinder 2. Piston 32 is connected to crankshaft 27 by a crank pin arranged to provide a 90° phase difference between the reciprocation of pistons 12 and 32.

As illustrated, the cold chamber 29 of cylinder 2 is connected by a gas passage 34 to the hot chamber 33 of cylinder 3. This connection is made via a cooler 35 a regenerator 36 and a heater 37 adjacent the hot chamber 33. In practice the heating is provided by combustion gases ducted over the upper part of the cylinder and the cooler uses water as a coolant. Arrows indicate the flow of working fluid between the hot and cold chambers. By means of gas passage 34, cold chamber 29 and hot chamber 33 are united into a single closed working volume within which working gas operates broadly in accordance with the Stirling engine cycle.

Cylinder 2 is offset axially of the crankshaft 27 to a sufficient extent to allow clearance between adjacent lever arms, connecting rods and crankshaft connections. The other two cylinders 1 and 4 are arranged respectively behind cylinders 2 and 3 and are not shown. They are similarly offset slightly from each other and are connected to the crankshaft via crank pins set at suitable angles to give 90° phase angles between cylinders 1 and 2, 2 and 3, 3 and 4 and thus also 4 and 1. Cylinder 2 is shown at mid-stroke while cylinder 3 is at TDC. There are a total of 4 gas passages corresponding generally to gas passage 34, each connecting the cold chamber of one cylinder with the hot chamber of an adjacent cylinder. In each case there is a corresponding 90° phase angle between each pair of interconnected chambers.

Figure 2:
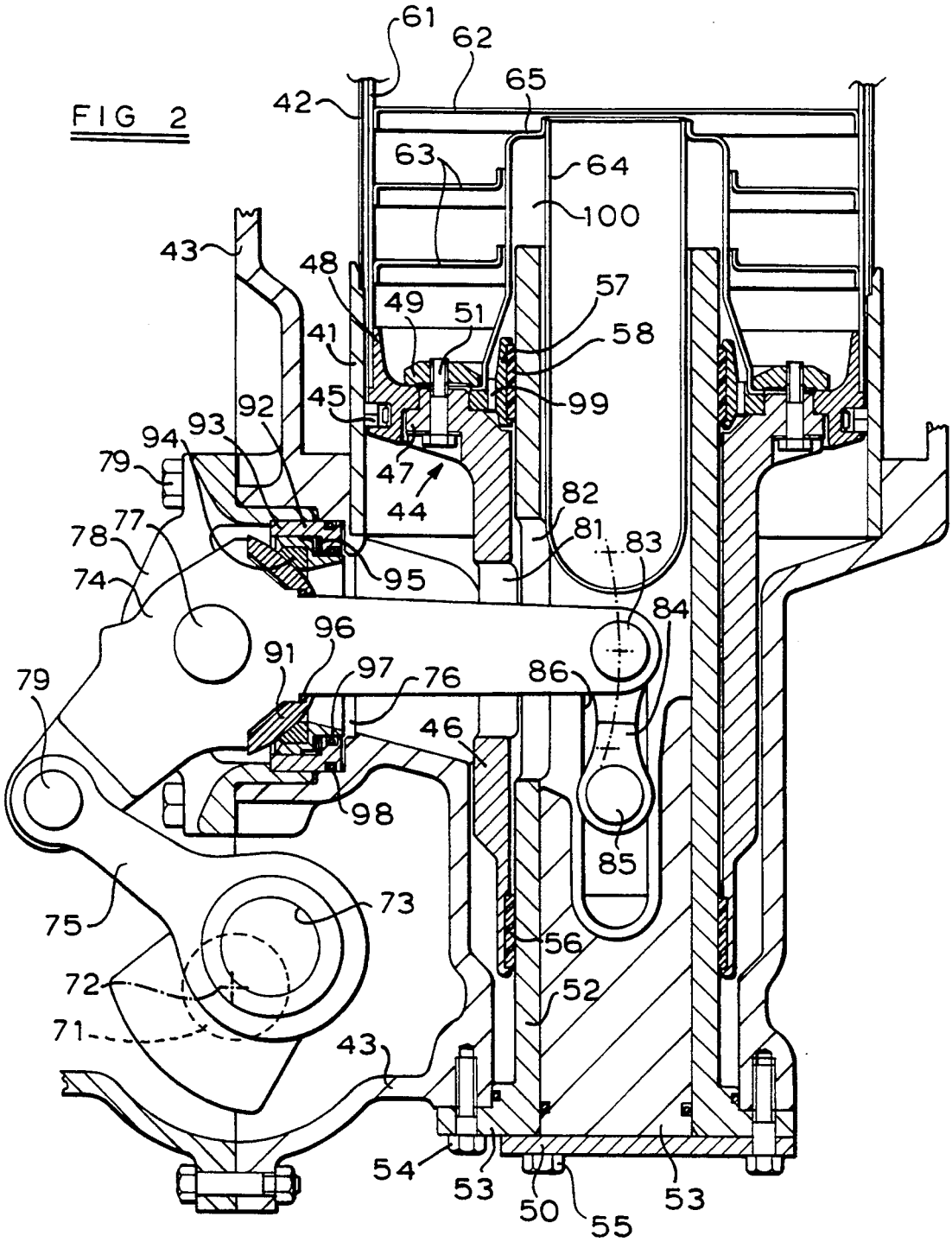
FIG. 2 shows part of such an engine in greater detail.

This general arrangement of four cylinders, 90° phase angles and interconnection of hot and cold working chambers is a well known form of Stirling engine layout, known as the Rinia layout so further details of its operation and will not be described here. FIG. 2 shows details of one cylinder of an engine similar to that of FIG. 1 but with some detail differences in layout.

The cylinder for the engine is constituted primarily by a stainless steel cylinder liner 41 the internal face of which provides a surface against which a piston seal 45 slides. The cylinder extends upward into a heater head by means of a closed cylindrical stainless steel spinning 42 which forms a heater head liner. In use heat is applied continuously to the heater head so that working fluid is heated and the space above the piston becomes a hot working chamber. Similarly the region below the piston is cooled continuously, for example by a water cooler surrounding the liner 41 to provide a cold working chamber below the piston. Further details of the heating and cooling arrangements may be as in FIG. 1. The interior surface of the liner 42 makes no contact with the piston or a displacer carried on the piston. The liner 41 itself is carried in a main casting 43 which forms an outer cylinder and also forms part of the crankcase of the engine.

A piston 44 is arranged to reciprocate in the cylinder but makes no direct contact with the cylinder for guidance. A sliding seal between the piston and cylinder is constituted by a piston seal 45.

The primary structural element of the piston is a cast aluminium alloy piston body tube 46 of substantially greater length than a conventional piston. The piston body tube 46 incorporates an upper external flange 47 on which is mounted an outer piston body 48 of stainless steel carrying the piston seal 45 in an external annular groove. The outer piston body 48 is secured to flange 47 by interlocking spigots between these components, a retaining ring 49 and bolts 51 passing through flange 47 and retaining ring 49. The retaining ring 49 holds other components in position and these will be described subsequently.

A fixed cylindrical tubular piston guide 52 extends up into the cylinder in an axial direction. It is secured at its lower end to the crankcase formed by casting 43 as will now be explained. The piston guide 52 incorporates a lower external flange 53 which forms a spigotted connection to the crankcase and is secured to the crankcase by a ring of studs 54. The lower end of the piston guide 52 is closed by an externally flanged closure member 50 which is secured to the crankcase by bolts 55, these bolts passing through flange 53 and thus providing further fixing for the piston guide 52. Separate sets of bolts 54 and 55 are provided so that the piston guide 52 can be installed before the closure member 50 as an aid to assembly of other parts of the engine.

The piston is guided for sliding movement on the piston guide 52 which extends up into the piston body tube 46.

The interior of the piston tube body forms a recess which is closed at its upper end as will be described subsequently. The interior surface of the piston body tube 46 carries a lower annular bearing pad 56 and also supports a bearing pad carrier 57 which carries an upper bearing pad 58. These bearing pads are typically of bronze impregnated PTFE. The piston guide 52 is typically formed of electroless nickel/PTFE plated mild steel to provide a bearing surface for the pads 56 and 58 which will operate satisfactorily in an oil free environment.

The upper bearing pad carrier 57 is secured in a spigot at the upper end of the piston body tube by the retaining ring 49.

The piston 44 also incorporates a displacer crown assembly made up from stainless steel sheet pressings and spinnings. This is conventional Stirling engine technology so only part of the displacer crown assembly is shown. The drawing shows part of a dome-topped cylindrical displacer crown 61. A series of full flanged bulkheads 62 and open-centre flanged bulkheads 63 serve to restrict heat transfer from above the displacer crown into the body of the piston and also to stiffen the displacer crown. Blocks of lightweight thermal insulation material may be arranged between and supported by adjacent bulkheads. The displacer crown 61 itself is mounted on the outer piston body 48 and is secured by spot welding.

The upper part of the displacer crown assembly closes the recess in the piston across the piston diameter above the upper end of the piston body tube 46 so that the interior of this tube becomes a recess open at its lower end and closed at its upper end.

For the functioning of the Stirling engine, it is desirable that the free volume below the piston including the volume within the recess referred to above should be kept to a reasonable minimum. For this purpose, a domed cylindrical internal filler member 64 is mounted on the piston to form part thereof and extends down inside the piston body tube 46. Filler member 64 is a stainless steel spinning and it is mounted in position by a further spun member 65 which in turn is secured to the piston body tube 46 by retaining ring 49. Members 64 and 65 also help to restrict heat transfer down through the piston.

As thus far described, piston 44 is freely slidable in an axial direction in cylinder 41 and is guided to slide on the axially extending piston guide 52 by lower and upper bearing pads 56 and 58. This guide mechanism holds the outer surface of the piston clear of the cylinder 41.

Piston seal 45 serves only as a sliding seal and not as a guide for the piston. Because of the laterally unsupported displacer crown well above the upper pad 58, a near-constant sliding fit between this pad and the piston guide is particularly important to piston location.

The main factors affecting relative thermal expansion of the piston body tube 46 and the piston guide 52 and the associated bearing pads are as follows. As the bearing pad carrier 57 expands, the effective thickness of the bearing pad 58 also increases by thermal expansion at a higher rate because it has a higher expansion coefficient, tending to take up clearance generated by expansion of the carrier. The bearing pad should be a split or segmented annulus to resist the tendency for its overall diameter to increase. The piston guide 52 also tends to expand but to a lesser extent because it is made of material with a lower expansion coefficient. The materials and dimensions of the piston guide 52, the bearing pad carrier 57 and bearing pad 58 can be selected so that they exhibit complimentary thermal expansions, such that the clearance between the pad and the guide remains substantially constant with temperature changes. This facility for substantially constant clearance with increasing temperature becomes a practical possibility because the piston is outside its guide. A piston normally has a much higher expansion co-efficient than its guide or cylinder because a piston tends to be of light high-expansion material whereas a cylinder or guide tends to be of low-wear low-expansion material. Similarly a bearing pad material tends to have a high expansion co-efficient so that it can expand into an increasing clearance. One would not expect to be able to select a piston and pad with a suitable composite expansion rate to match the expansion of an external cylinder used as a guide.

There should be a slight bias towards increasing clearance with increasing temperature to guard against seizure in the event of overheating. Any overheating of the engine is more likely to affect the piston than the piston guide, so there is a tendency to increase clearance when overheating occurs and this is a safety factor. The piston body tube and the piston guide are also reasonably well insulated thermally from the hot working chamber of the engine above the piston, restricting their temperature changes and thus their thermal expansion and helping to prolong their working life.

Similar considerations relating to clearance and thermal expansion apply at the lower bearing pad 56. Also, thermal expansion is less critical in this area because temperature changes are much less at the lower end of the engine.

A large differential expansion between liner 41 and the piston can be expected because the low coolant temperature employed in a Stirling engine keeps the liner much cooler than the piston and because the low thermal inertia of the piston causes it to heat quickly. This differential expansion can be accommodated because the piston is not guided in the cylinder.

A crankshaft 71 is mounted in the crankcase formed in main casting 43 to rotate about an axis 72 in bearings which are not shown. The crankshaft has a conventional offset crank pin 73. The main components interconnecting the piston and crankshaft are a lever arm 74 and a connecting rod 75.

Lever arm 74 extends through an opening 76 which is effectively within the wall of the cylinder. It is pivotally mounted about a pivot bearing comprising a pivot pin 77 which is fixed at both ends in a pivot housing 78 secured by bolts 79 to the main casing 43. The outer end of lever arm 74 is connected by pin 79 to the connecting rod 75 and in this way, crankshaft rotation is coupled to reciprocatory pivotal movement of the lever arm 74.

The inner end of the lever arm 74 extends into the cylinder 41 and lies substantially on the axis of the cylinder. To provide clearance for insertion and reciprocation, the piston body tube 46 incorporates a slot 81 and the piston guide 52 incorporates a slot 82. Lever arm 74 terminates in an upper piston pivot pin 83 which connects the lever arm to a piston link 84 which is forked to provide pivot pin anchorages to both sides of the lever arm 74. A lower piston pivot pin 85 passes through the lower end of the piston link and through slots 86 in the piston guide 52 to terminate in bores (not shown) in the piston body tube 46. In this way, the piston 44 is connected for reciprocal movement with the lever arm 74, the link 84 catering for the radial component of movement of the lever arm 74 with respect to the cylinder.

Conventional lubrication can be employed for the crankshaft and connecting rod bearings and for the pivotal movement of the lever arm 74 about pivot pin 77. Lubrication passages can also be provided in the lever arm 74 and link 84 to provide lubrication for pivot pins 83 and 85. Alternatively the pivot pins 83 and 85 may employ dry lubrication techniques.

A gas-tight seal is associated with pivotal movement of the lever arm 74. The lever arm itself carries a part-spherical seal seat 91 which is mounted on the lever arm with its centre coincident with the centre of the pivot axis of the lever arm. A fixed annular seal carrier 92 is mounted in casting 43 and carries a movable seal holder 93 which in turn carries an annular seal member 94 with a part-spherical surface in contact with the corresponding surface of the seal seat 91. An annular spring 95 which may be in the form of a wavy washer is arranged to urge the seal holder 93 and the seal member 94 in an outward direction to provide sealing contact with seat 91. A series of O-rings 96, 97 and 98 provide further sealing between components of the seal assembly. The seal member itself may be of a highly impenetrable grade of PTFE/bronze composite, possible alternatives being polyimide resins or PTFE/polyimide mixtures. The seal seat may have a ground stainless steel surface or it may be electroless plated with PTFE and a metal. A ceramic seal seat is an alternative.

The seal is self adjusting in that as wear takes place at the spherical bearing surfaces, the seal member and seal holder are maintained in contact with the seal seat. The seal is arranged to be such that internal pressure within the cylinder acts on the seal holder both to increase the bearing pressure between the seal member and the seal seat and to move the seal holder in a direction to take up wear. Effective take up of wear is possible because the movement available has a component normal to the wearing surfaces. Spring 95 establishes initial contact for sealing purposes.

The engine shown in FIG. 2 is a double acting four-cylinder Stirling engine corresponding to the layout shown in FIG. 1. Only one cylinder is shown. In use, the region of the cylinder above the piston is a hot working chamber and the region of the cylinder below the piston is a cold working chamber. This lower region departs somewhat from cylindrical shape due to the mechanical connection to a piston via the lever arm 74 and due to the mounting of the piston guide. This shape departs further from that of a cylinder as such due to the requirement for reducing the effective volume below the piston to a reasonable minimum when the piston is at its lowermost position. However, pressure below the piston acts on the full area of the piston, providing in effect a full area piston extending across the cylinder and subject to pressure.

In use, the working space within the cylinder below the piston is operated as a cold working chamber in the Stirling engine with the result that working gas is at a relatively low temperature. This keeps the temperature of the lower bearing pad 56 low. On the other hand, the upper bearing pad 58 is remote from the main cold working space below the piston and could be at an undesirably high temperature due to heat transfer through the piston from the hot working chamber. To reduce this effect, cold working fluid is caused to flow past the upper bearing pad. The pad carrier 57 is provided with vents 99 to allow working gas to pass through it. The annular volume 100 immediately above the piston guide 52 and also confined by members 64 and 65 increases and decreases during engine reciprocation, causing cold working gas to pass through the vents 99. Some gas in volume 100 also enters and leaves through the annular gap between filler member 64 and the interior of piston guide 52 but by keeping this gap to a reasonable minimum there is significant gas flow through the vents. This flow of gas tends to hold down the temperature of the bearing pad carrier 57 and bearing pad 58.

The vents 99 may be made asymmetric so that air flows more easily in one direction through them than in the other direction. For example, one end may be provided with a sharp acute angled edge while the other end is provided with a rounded edge. The result of such an arrangement is a net circulation of cooling working fluid through the bearing pad carrier 57 instead merely of equal alternate flows in both directions.

The arrangement shown allows a compact four-cylinder engine to be produced. The cylinders are arranged in two parallel banks of two cylinders, one to each side of the crankshaft axis 72. The two banks are offset in the direction of the crankshaft by a distance equivalent to half the pitch between the cylinders in one bank. This allows clearance for pivot housing 78 and connecting rod 75 between lower minor diameter portions of two cylinders of the other bank, thus allowing the major diameter portions of the two cylinder banks to be close together and thereby permitting a compact design. Although a relatively long cylinder is required to accommodate the piston body tube and piston guide, the lower part of this cylinder is of reduced diameter which conveniently provides clearance for the crankshaft. Thus a compact overall engine design can be provided.

In the usual way for a Stirling engine the hot working chamber of one cylinder is in continuous connection through heating and cooling facilities with the cold working chamber of another cylinder which is operating at an appropriate phase angle to the first mentioned cylinder.

Figure 3:
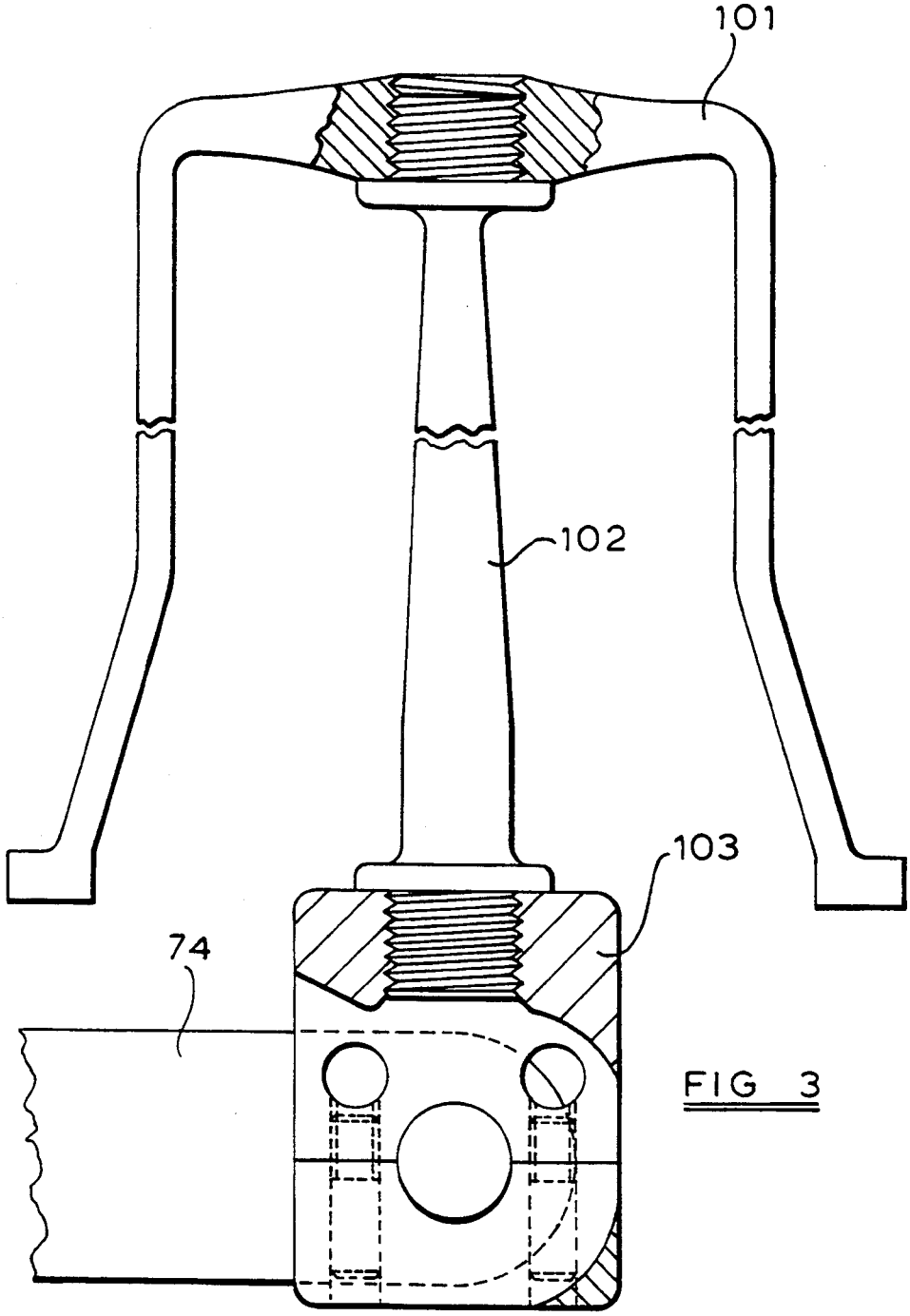
FIG. 3 shows a modification of part of FIG. 2.

In one modification of the engine, illustrated in FIG. 3, the pivoted piston link 84 may be replaced by a flexible link. In a typical pivoted link, the angular movement at pivot 85 is about 2°. By lengthening the link, providing it with some flexibility and preferably extending it upward rather than downward, bearing 85 may be replaced by a fixed anchorage. In one example, the effective angular displacement of the flexible link is reduced to 0.5°. The degree of flexibility can be chosen such that the combined side loads produced by bending of the link and by the axial load operating through an angled link is no greater for the long flexible link than for a shorter pivoted link. FIG. 3 shows a bell shaped light metal casting 101 which serves as a replacement for filler member 64 and the spun member 65 in the interior of the piston as shown in FIG. 2. Casting 101 serves as anchorage for a long flexible link 102 which terminates at its lower end in a bearing block 103 which is pivoted to the lever arm 74 in place of the link 84. The flexible link is shown to be connected at both ends by screw threads but any other convenient form of anchorage may be used.

In a still further modification, the piston guide 52 may be water cooled to keep down the temperatures at the bearing pads.

Water cooling could also be provided for the reduced diameter part of the cylinder to reduce further the temperature of working gas at the cold end of the cylinder. The shape of the lower part of the piston body tube 46 could then also be adapted to provide a flow of gas across the cooled cylinder surface in such a way as to provide effective cooling with very little additional pumping loss.

The change in volume of the lower annular part of the cold working chamber may also be used in conjunction with suitable ducting to induce flow through the vents 99 in the pad carrier 57.

The crank and connecting rod mechanism results in piston movement which departs from a pure sinusoidal movement.

In contrast with a simple crank and piston mechanism, (for which the piston displacement over top dead centre is increased compared with simple harmonic motion) with this arrangement the piston displacement for a given crank movement is decreased compared with simple harmonic motion. This can be of advantage because it extends the time available about top dead centre during a working cycle for heat transfer to the expanding gases and thus the amount of heat transfer during this critical stage.

It is also possible to induce rise of the piston which is asymmetric in comparison to the fall of the piston by altering the crank mechanism geometry. For this purpose the positions of the upper connecting rod pivot at extremities of lever arm movement would not be in alignment with a line through the crankshaft axis and the lower connecting rod bearing axis when the lever arm is at these extremes. A slower fall rate than the rise rate is useful because it allows more heat transfer during the expansion phase.

In a still further modification, variable geometry could be introduced into the lever arm mechanism to provide an engine with a variable stroke or to cater for other variations in the mechanism. For example, if the lever arm is connected to some kind of linearly movable device instead of to a crankshaft, the movement ratio between the piston and the linearly movable device could be varied by variations in geometry. One way of varying the geometry is to provide for adjustability of the position of the lever arm pivot such as 77, simultaneously moving the seal with the pivot.

As a departure from the four cylinder double-acting layout, two single acting cylinders could be employed. The layout could be generally as shown in FIGS. 1 and 2 but with the upper hot chamber of one cylinder and the lower cold working chamber of the other cylinder omitted.

A further alternative would be a single cylinder arrangement with a supplementary lower piston co-axial with the main piston. The supplementary piston should be connected to the crankshaft at such a phase angle as to provide the required relationship between expansion and contraction of the hot and cold working chambers so that the chambers from the same cylinder can be interconnected to provide a Stirling engine.

I claim:

1. A Stirling engine comprising a cylinder closed at one end, a piston reciprocable in the cylinder without guiding contact between the outer surface of the piston and the cylinder and a mechanical coupling for connecting reciprocatory movement of the piston to a drive member, characterised in that a fixed piston guide with external guide surfaces extends in arm axial direction within the cylinder towards its closed end and terminates in a recess in the piston and in that internal guide surfaces on the piston are in sliding engagement with the external surfaces of the piston guide whereby the piston is guided within the cylinder.

2. An engine as claimed in claim 1 characterised in that the coupling to the piston comprises a lever arm pivotable intermediate its ends and extending through the cylinder wall, connected at one end thereof to the piston and at the other end thereof to a main shaft.

3. An engine as claimed in claim 2 characterised in that the main shaft is a crankshaft and the lever arm is connected to the crankshaft by a connecting rod.

4. A Stirling engine as claimed in claim 3 characterised in that the crank and connecting rod geometry is such that piston displacement for a given crank angle is decreased when the piston is adjacent the closed end of the cylinder as compared with corresponding displacement for simple harmonic movement.

5. An engine as claimed in claim 2 characterised in that the lever arm is connected to the piston by a link which is substantially axial of the cylinder.

6. An engine as claimed in claim 5 characterised in that the link is a flexible member fixed to the piston and pivotally connected to the lever arm.

7. An engine as claimed in claim 1 characterised in that the fixed piston guide is a cylindrical tubular guide.

8. An engine as claimed in claim 1 characterised in that the piston comprises a piston body tube which is guided for sliding movement on the piston guide.

9. A Stirling engine comprising a cylinder closed at one end, a piston reciprocable in the cylinder without guiding contact between the outer surface of the piston and the cylinder and a mechanical coupling for connecting reciprocatory movement of the piston to a drive member, wherein a fixed piston guide with external guide surfaces extends in an axial direction within the cylinder towards its closed end and terminates in a recess in the piston and internal guide surfaces on the piston are in sliding engagement with the external surfaces of the piston guide whereby the piston is guided within the cylinder;

the piston comprises a piston body tube which is guided for sliding movement on the piston guide; and the piston body tube is guided on the piston guide by upper and lower annular bearing pads.

10. An engine as claimed in claim 9 characterised in that the materials and dimensions of the piston, the bearing pads and the piston guide are such that clearance between the guide and each pad remains substantially constant with changes in temperature.

11. An engine as claimed in claim 9 characterised in that the materials and dimensions of the piston, tile bearing pads and the piston guide are such that clearance between the guide and each pad increases with increasing temperature.

12. A Stirling engine as claimed in claim 9 characterised in that the upper bearing pad is carried by a bearing pad carrier mounted to the piston body tube.

13. A Stirling engine as claimed in claim 10 characterised in that the carrier incorporates vents through which gas is caused to flow during reciprocation of the piston to cool the upper bearing pad.

14. A Stirling engine as claimed in claim 1 characterised by having four double-acting cylinders.

15. An engine as claimed in claim 14 characterised in that the cylinders are in two parallel banks with the cylinders of one bank offset by half of the pitch between cylinders from the cylinders in the other bank and in that the main shaft lies between the lower minor diameter ends of the cylinders.

* * * * *